US006273751B1

(12) United States Patent
Francaviglia

(10) Patent No.: US 6,273,751 B1
(45) Date of Patent: Aug. 14, 2001

(54) ELECTRICAL SHORTING ASSEMBLY FOR ELECTRICAL JACKS AND THE LIKE

(75) Inventor: Joseph N. Francaviglia, St. Charles, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 09/618,572

(22) Filed: Jul. 18, 2000

Related U.S. Application Data

(63) Continuation of application No. 09/164,261, filed on Sep. 30, 1998.
(60) Provisional application No. 60/098,277, filed on Aug. 28, 1998.

(51) Int. Cl.[7] ..... H01R 31/08
(52) U.S. Cl. ..... 439/511
(58) Field of Search ..... 439/510, 511, 439/513, 76.1, 188, 676

(56) References Cited

U.S. PATENT DOCUMENTS

| | | | | |
|---|---|---|---|---|
| D. 399,827 | * | 10/1998 | Gaffney | D13/147 |
| 3,258,649 | | 6/1966 | Arguin et al. | 439/76.1 |
| 4,274,691 | | 6/1981 | Abernethy et al. | 439/188 |
| 4,863,393 | | 9/1989 | Ward et al. | 439/188 |
| 4,874,333 | | 10/1989 | Reed | 439/188 |
| 5,037,320 | | 8/1991 | Stolte | 439/188 |
| 5,123,854 | | 6/1992 | Petersen et al. | 439/188 |
| 5,257,941 | * | 11/1993 | Lwee et al. | 439/65 |
| 5,274,918 | * | 1/1994 | Reed | 29/884 |
| 5,310,360 | | 5/1994 | Peterson | 439/571 |
| 5,312,273 | | 5/1994 | Andre et al. | 439/188 |
| 5,419,720 | | 5/1995 | Chen | 439/676 |
| 5,556,307 | | 9/1996 | Johnston | 439/676 |
| 5,586,908 | | 12/1996 | Lorrain | 439/511 |

OTHER PUBLICATIONS

Two sketches of the rear side of a modular jack sold by Senior Industries, Inc. of Wood Dale, Illinois, prior to Aug. 28, 1997.

* cited by examiner

*Primary Examiner*—Tulsidas Patel
(74) *Attorney, Agent, or Firm*—Fitch, Even, Tabin & Flannery

(57) ABSTRACT

A shorting assembly is provided for shorting contacts of an electrical connector. A first shorting bridge having a plate portion and extensions interconnects a first set of electrical contacts preselected for shorting. A second shorting bridge having a plate portion and extensions interconnects a second set of electrical contacts preselected for shorting. The extensions project into bottom portions of guide slots for the contacts of the electrical connector to provide a reliable shorting connection. An insulator spaces the shorting bridges from one another. The shorting bridges and the insulator are mounted in a stack like manner to the electrical connector.

2 Claims, 3 Drawing Sheets

ELECTRICAL SHORTING ASSEMBLY FOR ELECTRICAL JACKS AND THE LIKE

CROSS-REFERENCE TO RELATED APPLICATION

This is a continuation of copending U.S. application Ser. No. 09/164,261, filed Sep. 30, 1998, which claims the benefit of U.S. Provisional Application No. 60/098,277, filed Aug. 28, 1998.

FIELD OF THE INVENTION

The present invention relates to electrical jacks and, more particularly, to an improved shorting assembly for electrical contacts of electrical jacks and the like.

BACKGROUND OF THE INVENTION

Electrical jack type connectors are used in a wide variety of industries, including the telecommunications industry, for interfacing with plugs on ends of cords and wires used to interconnect various system components. Modular jacks are one of the most common types of electrical jacks because of their compact and lightweight design configuration that enables them to be readily and easily incorporated into the body and electrically connected to the system of many different component applications and configurations, including those of relatively small size.

In a typical modular jack, a housing body defines a socket shaped to receive in a quick connect/disconnect fashion a complementary shaped, industry standard modular plug. To form an electrical connection with the plug, modular jacks commonly include a number of side-by-side wire contacts that extend across the socket. The number of wire contacts varies depending on the application of use and can be as many as ten. The plug includes plug contacts that engage the necessary number of wire contacts as the plug is inserted and locked in the socket.

The wire contacts in a typical modular jack are designed to bias across the socket and into engagement with the plug contacts to provide a reliable electrical connection. Each wire contact typically includes a tail portion fixed relative to the housing and electrically connected to the circuitry of the particular component, an opposite free end portion and an intermediate contact portion that extends across the socket between the fixed and free end portions for contact with the plug contacts. The intermediate contact portion and the free end portion of the wire contact are shifted against the natural bias of the wire contact from a non-engaged position to an engaged position upon plug insertion.

In many situations, it is common that the circuitry of a particular system requires certain of the plug contacts to be selectively shorted with one another. For example, in modular jacks with eight wire contacts, there are instances in which the operating circuitry of the component requires shorting of as many as four of the non-engaged wire contacts. It is important that the shorting connections be reliable and capable of withstanding relatively heavy use. Specifications are known to require modular jacks to withstand 500 to 750 cycles of plug insertion and removal.

However, modular jacks have been found to produce undesirable intermittent electrical contact caused, in significant part, by ineffective shorting designs. For instance, one known shorting design employs cross-over wires interconnecting the free end portion of the wire contacts identified for shorting. More specifically, in typical modular jacks, each of the free end portions of the wire contacts extend through a slot at the rear of the housing. The slots each have a bottom end portion and an open end portion and are defined by a number of side-by-side thin fins. The slots insulate the wire contacts against contact with one another and guide the deflection caused by the plug being inserted into the socket. With this jack design, the end portions of the cross-over wires are bent and tucked generally into the slots containing the free end portions for the wire contacts preselected for shorting. Upon plug insertion, the non-engaged contacts remain biased against the end portions of the cross-over wires.

The thin slot forming fins are known to deflect and allow misalignment between the end portions of the cross-over wires and the free end portions of the wire contacts in the slot. Typically, both the wire contacts and the cross-over wires have a circular cross-section which increases the potential for the wires at the shorting connection to shift against one another and become misaligned. It also is known that the end portions of the cross-over wires are not adequately tucked into or otherwise positioned in the slots, such as in the slot bottom portion, and as a result, the fins tend to deflect and allow misalignment. Fin deflection increases the potential for interference with the shifting of adjacent wire contacts that are necessary for engagement with plug contacts. As a result, jacks with this type of shorting design tend to produce undesirable intermittent electrical connections and fail reliability standards.

Another known designs employs a printed circuit board type assembly mounted to the rear of a jack of the type described above. The board includes a number of grooves in alignment with and adjacent to the slot bottoms containing the biased wire contacts designated for shorting. Each groove is lined with an electrical conductive material, such as gold foil, and is positioned with respect to its particular slot such that the wire contacts designated for shorting bias into electrical contact with the respective foil lined groove. The board includes an electrical path masked between the grooves to provide the shorting interconnection. An undesirable shortcoming of this design is the intermittent electrical connections known to occur at the shorting connections due to the conductive material flaking and pulling loose from the grooves. This is especially a concern in situations with even modest cycling requirements.

Thus, there is a need for a more reliable shorting assembly for electrical contacts of jacks and the like that reduces potential for intermittent shorting connections and withstands relatively heavy use.

SUMMARY OF THE INVENTION

The present invention is directed to providing an improved shorting assembly for electrical contacts of electrical jacks. In accordance with the present invention, there is provided an electrical connector assembly having a housing defining a socket for receiving a plug and a plurality of electrical contacts at the socket for electrical connection with the plug. The plurality of contacts include a first set that are preselected for shorting. A shorting connector is mounted at the housing and electrically interconnects the first set of contacts for shorting. The shorting connector has a first plate portion that forms at least a portion of the interconnection of the first set of contacts for shorting.

The electrical connector may also include a second set of contacts preselected for shorting at the housing. The shorting connector then also electrically interconnects the second set of contacts preselected for shorting and includes a second plate portion that forms at least a portion of the interconnection of the second set of contacts for shorting. The shorting connector also may include an insulator spacing the first and second plate portions.

The shorting connector also may include a first set of extensions that are electrically connected to the first plate portion and that extend into electrical contact with the first set of contacts for shorting. The shorting connector may include even further a second set of extensions that are electrically connected to the second plate portion and that extend into electrical contact with the second set of contacts for shorting.

The insulator may space the second plate portion from the housing. The first plate portion may be mounted adjacent the housing, and the insulator may space the second plate portion from the first plate portion. The insulator also may be mounted against the first plate portion, and the second plate portion may be mounted against the insulator. The shorting connector further may comprise at least one mount to attach the first and second plate portions and the insulator to the housing.

The housing may include a plurality of guides spacing the plurality of contacts. Each of the guides includes a bottom portion, and the first set of extensions extend into the bottom portions of the guides for the first set of contacts preselected for shorting to electrically contact the first set of contacts. The second set of extensions also may extend into the bottom portions of the guides for the second set of contacts preselected for shorting to electrically contact the second set of contacts.

The first set of extensions may project from the first plate portion and have a portion extending with a first predetermined angle relative thereto into the bottom portions of the guides for the first set of contacts preselected for shorting. The second set of extensions also may project from the second plate portion and have a portion extending with a second predetermined angle relative thereto into the bottom portions of the guides for the second set of contacts preselected for shorting. The predetermined angle may be in the range of 80 to 100 degrees.

Further, in accordance with the present invention, there is provided a shorting device for contacts of an electrical connector that includes a first shorting bridge that is made of electrical conductive material and has a plate portion. The shorting device also includes extensions that project from the plate portion of the first shorting bridge to provide a first electrical short interconnection through the plate portion of the first shorting bridge.

The shorting device also may include a second shorting bridge that is made of electrical conductive material and that has a plate portion. The shorting device with the second shorting bridge also may include extensions that project from the plate portion of the second shorting bridge to provide a second electrical shorting interconnection through the plate portion of the second shorting bridge.

The shorting device may include further an insulator that spaces the plate portion of the first shorting bridge from the plate portion of the second shorting bridge. In addition, the first and second shorting bridges and the insulator may be assembled in a stack like manner in which the insulator is between and against the plate portion of the first and second shorting bridges.

The shorting device also may include a connector that secures the first and second shorting bridges and the insulator in the stack like manner. The connector may extend through the insulator and the plate portion of the first and second shorting bridges. Additionally, the insulator may have a plate like shape.

BRIEF DESCRIPTION OF THE DRAWINGS

The present invention will be described in connection with the accompanying drawings wherein.

DETAILED DESCRIPTION OF THE PREFERRED EMBODIMENT

Figure 1:
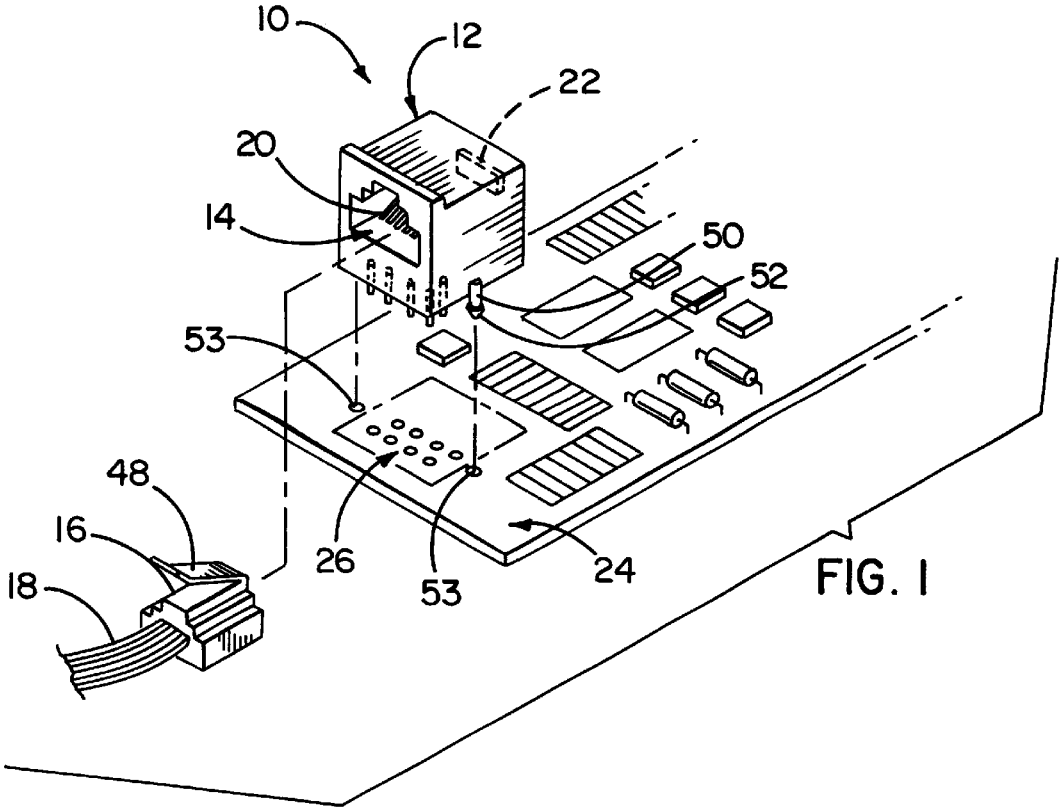
FIG. 1 is an exploded perspective view of a modular jack embodying features of the present invention, a printed circuit board on which the modular jack is capable of being mounted and a modular plug capable of being used with the modular jack.

Referring to FIG. 1, the present invention is illustrated in use with a modular jack 10 to provide reliable shorting connections. In general, the modular jack 10 includes a housing body 12 that defines a plug socket 14 that receives an industry standard plug 16 affixed to the end of a cord or wire 18. The modular jack 10 includes a number of side-by-side wire contacts 20 that are engaged by contacts (not shown) on the plug 16 when the plug 16 has been inserted into the plug socket 14. The wire contacts 20 extend through corresponding holes 26 on the printed circuit board 24 to be electrically connected to the circuitry of the printed circuit board 24.

A shorting assembly 22 is mounted to the outside of the housing body 12 opposite the socket 14 to short a preselected set of the wire contacts 20 in a manner that provides reliable shorting connections and withstands relatively heavy cycling with plugs.

Figure 2:
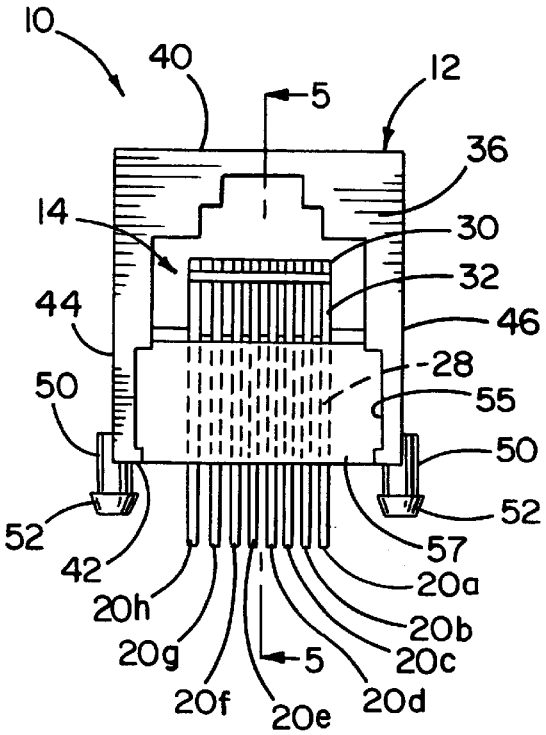
FIG. 2 is a front elevational view of the modular jack of FIG. 1.
Figure 3:
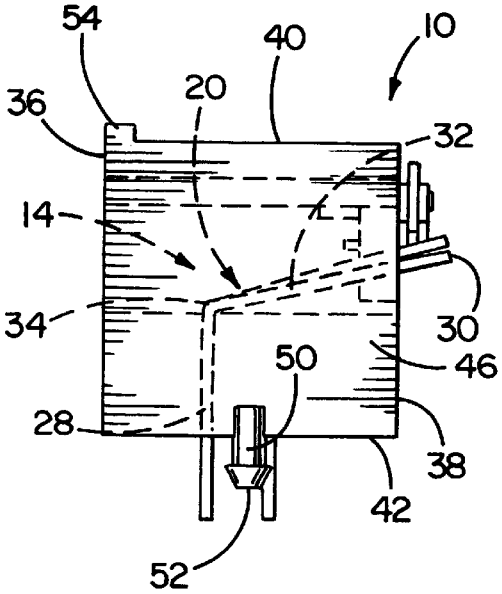
FIG. 3 is a right side elevational view of the modular jack of FIG. 1.

Referring to FIGS. 2 and 3, each of the wire contacts 20 is mounted and situated in the housing body 12 in a cantilever fashion so to bias upward and extend across a lower, rearward portion of the plug socket 14 for engagement by respective contacts on the plug 16. The wire contacts 20 each include a tail end portion 28 that is fixed relative to the housing body 12 and extends beyond the housing body 12 for connection to the circuitry of the printed circuit board 24 and an opposite, free end portion 30 that extends through the housing body 12 behind the socket 14. An intermediate contact portion 32 extends between the tail and free end portions 28 and 30 at an angle through the lower, rearward portion of the plug socket 14. The intermediate contact portion 32 and the free end portion 30 of each wire contact 20 are biased toward the center of the socket 14 by a bend 34 at the transition between the tail end portion 28 and the intermediate portion 32. The length of each portion of the wire contacts 20 depends primarily on the size of the modular jack, and typically, the intermediate portion is longer than both the tail and the free end portions, and the tail end portion is longer than the free end portion.

The wire contacts may be made from any electrical conductive material that is commercially available and meets the required specifications for the particular application. The preferred material has a maximum contact rating of 2 amps at 250 volts of alternating current, and a maximum contact resistance of 30 milliohms. The preferred material is 0.018 phosphor bronze with 30 micro inches of gold over 50 micro inches of nickel.

In accordance with the present invention, there are situations in which the particular application requires certain of the wire contacts 20 to be shorted with one another. The shorting assembly 22 of the present invention shorts these wire contacts through reliable contact with the free end portions of wire contacts in a manner that significantly reduces, if not eliminates in most cases, the potential for intermittent shorting contacts, including situations requiring relatively heavy usage, such as in the order of 500 to 750 cycles of plug connect and disconnect.

More specifically, the housing body 12 has an outer, generally rectangular profile defined by a front, rear, top, bottom and left and right side portions 36, 38, 40, 42, 44 and 46, respectively. The housing body 12 is of a lightweight, compact construction that is made from material that is sufficiently durable and provides suitable insulation resistance. For instance, the preferred housing body has a height in the range of about 0.730 to 0.760±0.015 in., a width in the range of about 0.625 to 0.635±0.015 in. and a depth in the range of about 0.500 to 0.645±0.015 in. and is made of polyester with glass (UL94V-O). The preferred insulation resistance is about 500 megohms per minute at 1000 volts of direct current.

The housing body 12 defines the plug socket 14 with a stepped pyramid-like shape that slidingly receives and guides the plug 16 into the socket 14 so that the contacts of the plug 16 engage the necessary wire contacts 20 for connection. The plug socket 14 opens through the front portion 36 of the housing body 12. The plug 16 is an industry standard design and includes a complementary outer stepped, pyramid-like shape to be guided by the socket 14. The plug 16 includes an outwardly biasing locking tab 48 that deflects toward the plug 16 to be inserted into the socket 14. After insertion of the plug 16 into the socket 14, the locking tab 48 biases against and cooperates with a portion of the housing body 12 adjacent the opening of the plug socket 14 to prevent removal of the plug 16. The locking tab 48 is easily deflected manually toward the plug 16 for release and removal of the plug 16 from the socket 14.

To mount the housing body 12 on the printed circuit board 24, a pair of mounting posts 50 project away from the bottom portion 42 of the housing body 12 at edges between the bottom portion 42 and each of the side portions 44 and 46. The posts 50 each include a barbed end 52 configured to allow insertion through the mounting holes 53 on the printed circuit board 24 and to prevent removal therefrom. Each post 50 has length sufficient to allow the barbed end 52 to pass through the hole 53 and to engage the opposite side of the printed circuit board 24 in a manner minimizing play between the mounted modular jack 10 and the printed circuit board 24. When mounted, the bottom portion 42 of the housing body 12 rests on the printed circuit board 24. The length of the posts depends generally on the thickness of the printed circuit board. The preferred posts extend integrally from the housing and have a preferred length of about 0.125±0.015 in. and are located about 0.320±0.015 in. from the front portion of the housing. The length of the posts also may be dependent on whether spacer posts that extend from the housing body are being used to space the modular jack from the printed circuit board.

As illustrated, the modular jack 10 is a right angle type jack because the tail end portions 28 of the wire contacts 20 extend beyond the bottom portion 42 of the housing body 12. The tail end portions 28 have length sufficient to reach from the housing body 12 and extend through the circuitry connection holes 26 defined by the printed circuit board 24. The connection holes 26 are lined with an electrical conductive material, and the tail end portions 28 are electrically connected thereto, such as by soldering. The attachment of the tail end portions 28 at the circuitry connection holes 26 also assists to stabilize attachment of the modular jack 10 to the printed circuit board 24.

The housing body 12 also includes a mounting rib 54 projecting from the top portion 40 adjacent an edge between the front portion 36 and the top portion 40. The rib 54 is designed to engage the housing or other structure of the component in which the modular jack is being incorporated to aid in locating, mounting and otherwise stabilizing the modular jack.

Figure 4:
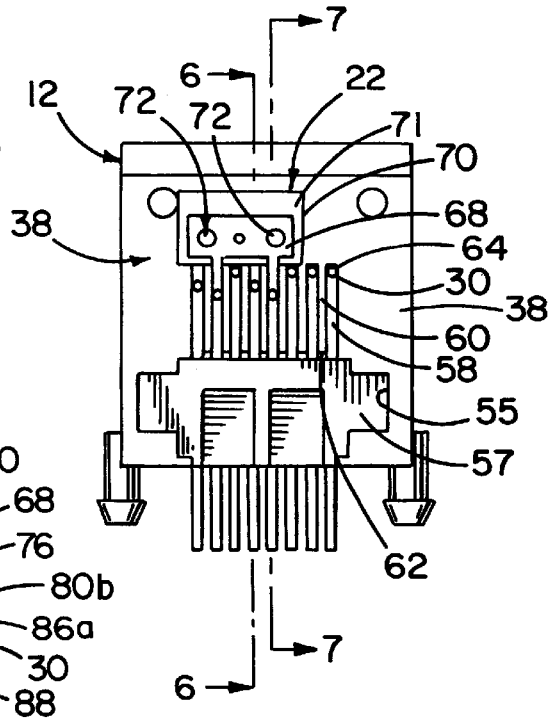
FIG. 4 is a rear elevational view of the modular jack of FIG. 1.

Referring to FIGS. 2–4, the wire contacts 20 extend through the lower, rearward portion of the socket 14 in a generally side-by-side parallel fashion. The bottom portion 42 of the housing body 12 defines a socket 55 designed to receive a wire contact mounting slide 57 having holes 56 (FIG. 6) in which the tail end portions 28 of the wire contacts 20 extend through and are fixed against movement relative thereto. The mounting slide 57 is secured in the socket 55, such as with a tight friction fit. This assembly is referred to as a two-piece housing. One-piece housing as well as any one of multiple piece housings may be used in conjunction with the present invention.

The holes 56 through the slide 57 are arranged in a predetermined pattern that matches that of the holes 26 through the printed circuit board 24 (FIG. 1) so that there is alignment of the holes 56 and 26 for mounting the modular jack 10. For instance, the holes 26 on the printed circuit board 24 are spaced in two parallel rows of four holes each and the holes of one row are offset from the holes of the other row. The holes 45 of the mounting slide 57 have the same pattern.

While the illustrated modular jack is a right angle design, other designs such as upright design or a wiring harness type design may be employed in accordance with the present invention. With a straight configured modular jack, a slide directs the tail end portions from the rear of the housing, and with a wiring harness type design, the tail end portions terminate in the slide but are electrically connected at the slide to a number flexible wires, which are, in turn, used to electrically connect the modular jack to the circuitry of the particular component.

Figure 8:
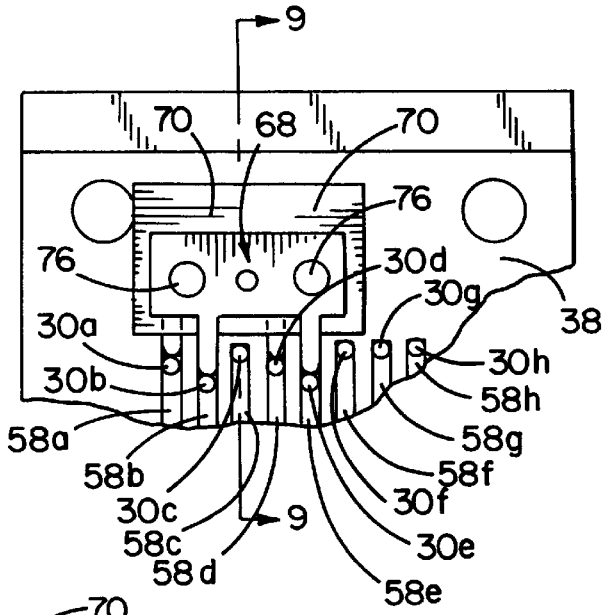
FIG. 8 is an enlarged, rear elevational view of a portion of the modular jack of FIG. 1.
Figure 9:
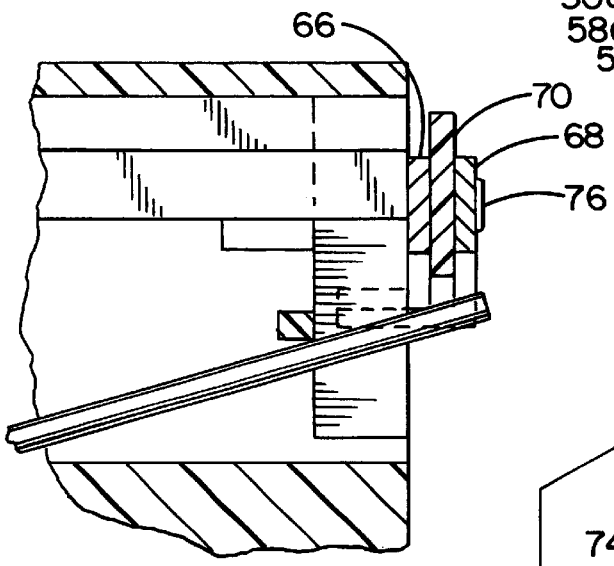
FIG. 9 is a cross-sectional view of the modular jack of FIG. 1 taken along line 9—9 of FIG. 8.

Referring to FIGS. 4 and 8, the rear portion 38 of the housing body 12 includes eight elongated slots 58*a–h* extending side-by-side and parallel. The slots 58*a–h* are partitioned by seven linearly and parallel extending fins 60. More specifically, the outer two slots 58*a* and 58*h* are defined on one side by the rear portion 38 of the housing body 12 and on the other, as with both sides of the remaining slots 58*b–g*, by the fins 60.

Each of the slots 58*a–h* includes a slot bottom portion 64 and an opposite open end adjacent a free end 62 of the each of the fins 60.

The illustrated modular jack 10 includes eight wire contacts 20*a–h* (FIG. 2) which include eight corresponding free end portions 30*a–h*.

Each of the free end portions 30*a–h* extends through one of the slots 58*a–h*. The slots 58*a–h* guide movement of the wire contacts 20*a–h* between the engaged position with the contacts of the plug 16 and the non-engaged position. The slots 58*a–h* allow movement of the end portions 30*a–h* therealong but restrict lateral movement to prevent contact among the wire contacts 20*a–h* and to ensure proper alignment and electrical connection with the contacts of the plug 16. Accordingly, each of the slots 58*a–h* is only slightly wider than the diameter of the free end portion 30*a–h* of the wire contact 20*a–h* extending therethrough.

Figure 5:
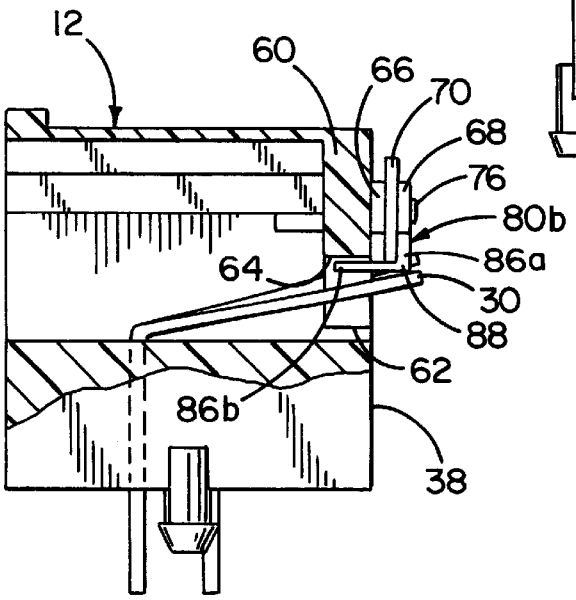
FIG. 5 is a cross-sectional view of the modular jack of FIG. 1 taken along line 5—5 of FIG. 2.
Figure 10:
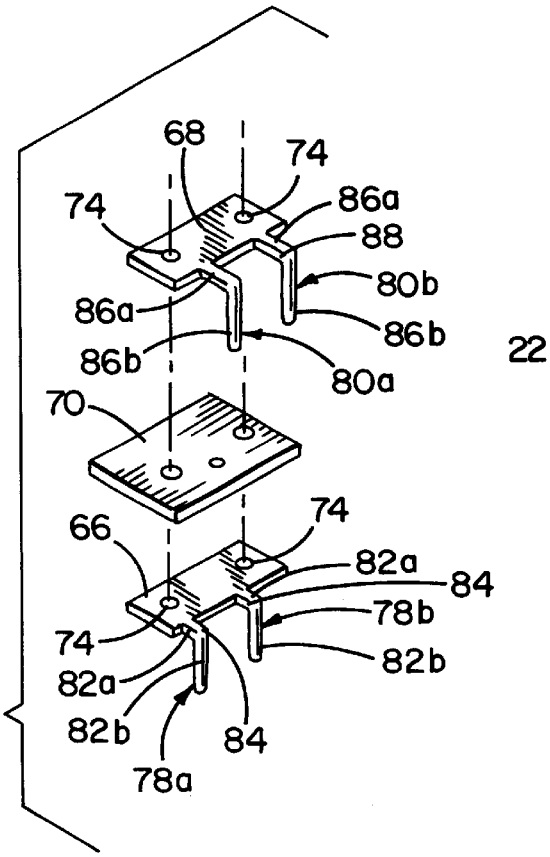
FIG. 10 is an exploded perspective view of a shorting assembly embodying features of the present invention.

Referring to FIGS. 4, 5 and 10, the shorting assembly 22 includes a first shorting bridge 66 and a second shorting bridge 68 that are spaced by an insulator 70. The first and second shorting bridges 66 and 68 and the insulator 70 are assembled in a stack-like manner and mounted to the rear portion 38 of the housing body 12 adjacent the bottom area 64 of the slots 58*a–f*. The shorting bridges 66 and 68 have a rectangular plate like shape and are made of any commercially available electrical conductive material meeting the required specifications for the particular shorting application. For instance, the preferred material has a maximum contact rating of 2 amps at 250 volts of alternating current, a maximum contact resistance of 30 milliohms and is made of 0.018 phosphor bronze with 0.00003 in. of gold over 0.00005 in. of nickel.

The insulator 70 also has a rectangular plate like shape but is made of any commercially available insulating material meeting the required specifications for the particular shorting application. For instance, the preferred material has an insulation resistance of about 500 megohms per minute at 1000 volts of direct current and preferably is made of polyester with glass (UL94V-O).

Figure 7:
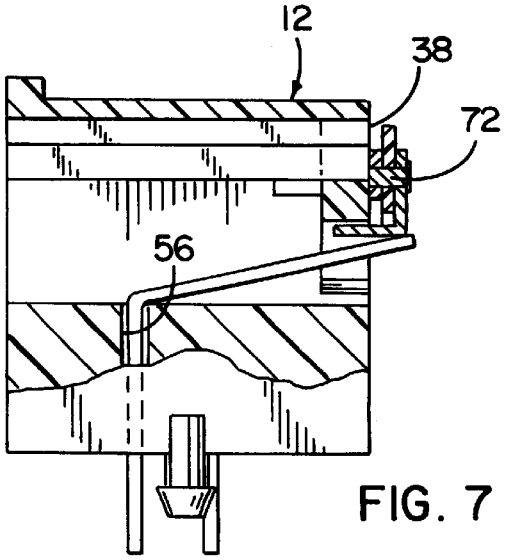
FIG. 7 is a cross-sectional view of the modular jack of FIG. 1 taken along line 7—7 of FIG. 4.

The shorting assembly 22 includes two spaced mounting posts 72 (FIG. 7) that extend generally perpendicular from the rear portion 38 of the housing body 12. Each of the shorting bridges 66 and 68 and the insulator 70 define a pair of mounting holes 74 spaced apart the same distance as the posts 72 and sized to receive the mounting posts 72 with minimal clearance therebetween so to prevent any unnecessary play. The placement of the mounting posts 72 and the mounting holes 74 are coordinated such that the shorting assembly 22 is located in close proximity to the slot bottom area 64 of the slots 58*a–f* (FIG. 8). For instance, as illustrated in FIGS. 5 and 8, the preferred location has the insulator plate 70 running in general horizontal alignment immediately adjacent the slot bottom area 64 of the slots 58*a–f*.

The shorting bridges 66 and 68 and the insulator 70 are stacked on the mounting posts 72 in a predetermined order such that the outer rectangular perimeters of the shorting bridges 66 and 68 are generally aligned with one another on opposite sides of the insulator 70. More specifically, the first shorting bridge 66 is mounted first and rests against the rear portion 38 of the housing body 12. The insulator 70 is mounted next and rests against the first shorting bridge 66, and then, the second shorting bridge 68 is mounted and rests against the insulator 70. Any number of shorting bridges with insulators may be stacked on top of one another to provide any number of shorting connections in accordance with the present invention.

To secure the stacked bridges 66 and 68 and insulator 70 tightly to the rear portion 38 of the housing body 12, the portion of the posts 72 extending above the second shorting bridge 68 is deformed or otherwise adapted to become larger than the holes 74.

In accordance with the present invention, the shorting assembly 22 has an overall low profile design to enable use with a variety of modular jacks having different sizes and shapes and used for different applications, especially those requiring relatively small jack sizes. For example, the preferred shorting assembly has a total assembled thickness in a range of about 0.060 to 0.065±0.0015 in. The preferred shorting bridges each have a thickness in the range of about 0.0134 to 0.0142±0.0015 in., and the preferred insulator has a thickness in the range of about 0.0193 to 0.0201±0.0015 in. Although the preferred height for the mounting posts for assembly is in the range of about 0.070 to 0.080±0.0015 in., such height is later reduced to within the preferred total assembly thickness to secure the assembly. For instance, the preferred mounting posts are integrally molded with the housing body and are made of material that is easily deformable by melting or otherwise without effecting the integrity of the shorting bridges.

The shorting bridges 66 and 68 are generally the same size and the insulator 70 is slightly larger such that a perimeter portion 71 extends out beyond the shorting bridges 66 and 68 when assembled to the housing body 12. The perimeter portion 71 provides reliable insulation between the shorting bridges 66 and 68. The area covered by the shorting assembly is to be relatively small so to consume as minimal of space as necessary on the rear of the housing body. The dimensions of the shorting bridges and insulator depend on the area available on the rear of the housing body or other structure and the spacing of the wire contact slots on the jack to which the shorting assembly is to be mounted. For instance, the preferred shorting bridges have a length in the range of about 0.231 to 0.241±0.005 in. and a width in the range of about 0.103 to 0.113±0.005 in. The preferred insulator has a length in the range of about 0.231 to 0.241±0.005 in. and a width of about 0.103 to 0.113±0.005 in.

The shorting assembly 22 includes a first pair of finger like extensions 78*a* and 78*b* projecting from the first shorting bridge 66 into the bottom portion 64 of the slots 58*a* and 58*d* for shorting preselected wire contacts 20*a* and 20*d*. The first extensions 78*a* and 78*b* project from one of the lengthwise sides of the shorting bridge 66 adjacent the bottom areas and are spaced so to be in alignment with the slots, such as slots 58*a* and 58*d*, into which they are to extend into the bottom areas thereof. Similarly, the shorting assembly 22 also includes a second pair of finger like extensions 80*a* and 80*b* projecting from the second shorting bridge 68 into the bottom portion 64 of the slots 58*b* and 58*e* for shorting preselected wire contacts 20*b* and 20*e*. The second extensions 80*a* and 80*b* project from one of the lengthwise sides of the shorting bridge adjacent the bottom areas 64 and are spaced so to be in alignment with the slots, such as slots 58*b* and 58*e*, into which they are to extend into the bottom areas thereof.

The first pair of extensions 78*a* and 78*b* are each segmented into a first segment 82*a* that extends perpendicularly from the first shorting bridge 66 and in the same general plane as the first shorting bridge 66 and a second segment 82*b* that extends at a predetermined angle relative to the first segment 82*a*. A bend 84 transitions the first segment 82*a* to the second segment 82*b* and disposes the two segments 82*a* and 82*b* at the predetermined angle. Similarly, the second pair of extensions 80*a* and 80*b* also are segmented into a first segment 86*a* that extends perpendicularly from the second shorting bridge 68 and in the same general plane as the second shorting bridge 68 and a second segment 86*b* that extends at a predetermined angle relative to the first segment 86*a*. A bend 88 transitions the first segment 86*a* to the second segment 86*b* and disposes the two segments 86*a* and 86*b* at the predetermined angle.

Figure 6:
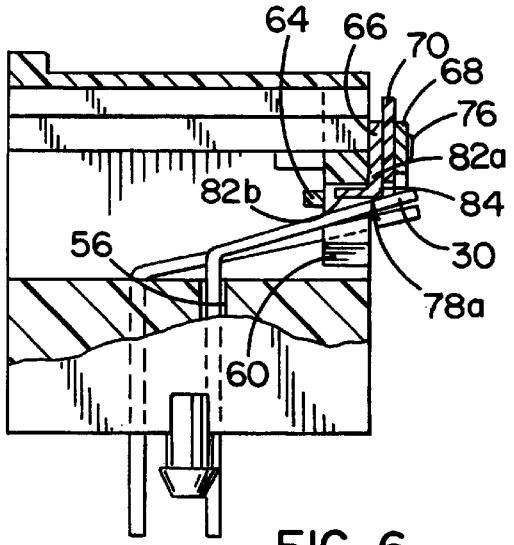
FIG. 6 is a cross-sectional view of the modular jack of FIG. 1 taken along line 6—6 of FIG. 4.

More specifically, with reference to FIGS. 4 and 8, the second segments 82*b* of the first set of extensions 78*a* and 78*b* of the first shorting bridge 66 extend into the first and fourth slots 58*a* and 58*d*, as counted from left to right, to interconnect the first and fourth wire contacts 20*a* and 20*d* for shorting. As also illustrated in FIG. 6, the bend 84 is made at a predetermined distance along the extensions 78*a* and 78*b* from the shorting bridge 66 to extend the second segments 82*b* into their respective slot 58*a* and 58*b* in the slot bottom area 64. Similarly, the second segments 86*b* of the second set of extensions 80*a* and 80*b* extend from the second shorting bridge into the second and fifth slots 58*b* and 58*e*, as counted from left to right, to interconnect the second and fifth wire contacts 20*a* and 20*d* for shorting. As also illustrated in FIGS. 5 and 6, the bend 88 is made at a predetermined distance along the extensions 80*a* and 80*b* from the second shorting bridge 68 to extend the second segments 86*b* into their respective slots 58*b* and 58*e* in close proximity to, if not engaged with, the slot bottom 64. The closer the second segments 82*b* and 86*b* are located to the slot bottom 64 the less potential there is for the fins 60 to deflect and the slots 58 to deform due to misalignment. The bends 84 and 88 position the second segments 82*b* and 86*b* in the bottom area 64 and may position the second segments 82*b* and 86*b* in contact with the bottom of the bottom area 64 or, alternatively, the second segments 82*b* and 86*b* angle through the slot bottom areas 64 at an angle matching that of the free end portions 30*a–h* of the wire contacts 20*a–h*. The preferred predetermined angle for both bends is in the range of 80 to 165 degrees.

While it is preferred to pre-bend the extensions before installing the shorting bridges 66 and 68, it also is in accordance with the present invention to bend the extensions during or after the shorting bridges 66 and 68 are mounted on the mounting posts 72 by sharply tucking the extensions in their respective slot at the desired bend angle.

The contact between the first and second set of extensions 78*a* 78*b*, 80*a* and 80*b* of the shorting bridges 66 and 68 and the free end portions 30*a*, 30*b*, 30*d* and 30*e* of the wire contacts 20*a*, 20*b*, 20*d* and 20*e* to be shorted may occur anywhere along the second segments 82*b* and 86*b*. The contact location depends on the length of the wire contact 20*a*, 20*b*, 20*d* and 20*e* and the extent to which the free end portion 30 extends through and even beyond the slot 58. Thus, the fingers 78*a*, 78*b*, 80*a* and 80*b* are to reach deep into the slots 58 such that the contact location can occur anywhere in the bottom area 64 of the slot 58 and slightly beyond.

More specifically, to reach sufficiently into the slots 58, the second segments 82*b* and 86*b* are longer than the first segments 82*a* and 86*a*, respectively, and preferably extend through the bottom area of the slot and provide sufficient surface area to make an adequate electrical connection with the wire contacts 20 that are designated for shorting. The preferred second segments have a length in the range of about 0.152 to 0.162±0.005 in. Moreover, due to the insulator 70 spacing the second shorting bridge 68 from the housing body 12, the second segments 86*b* of the second set of extensions 80*a* and 80*b* may be longer than those extending from the first shorting bridge 66 in order to extend sufficiently into the slots 58.

To further enhance the electrical shorting contact with the wire contacts 20 and to reduce potential for contact misalignment, the extensions 78*a*, 78*b*, 80*a* and 80*b* are substantially planar and are integral extensions from their respective shorting bridge 66 and 68. The width of the extensions 78*a*, 78*b*, 80*a* and 80*b* preferably extend the entire width of the slot into which they extend. The preferred extensions are made of the same material as the shorting bridges and have the same specification requirements.

In operation, as the plug 16 is inserted into the socket 14 of the modular jack 10, the plug contacts deflect downward the requisite wire contacts 20, such as those residing in slots 58*c*, 58*f*, 58*g* and 5*a–h*, for connection. The free end portions 30*a*, 30*b*, 30*d* and 30*e* of the wire contacts 20*a*, 20*b*, 20*d* and 20*e* preselected for shorting remain biased into the second segments 82*b* and 86*b* of their respective extensions 78*a*, 78*b*, 80*a* and 80*b* with sufficient force to create a reliable electrical connection for shorting therebetween. Alternative shorting configurations with other combinations of wire contacts may be employed in accordance with the present invention.

It will be understood that various changes in the detail, materials and arrangement of parts and assemblies which have been herein described and illustrated in order to explain the nature of the present invention may be made by those skilled in the art within the principle and scope of the present invention as expressed in the appended claims.

What is claimed is:

1. A shorting device for contacts of an electrical connector comprising:

a first shorting bridge being of electrical conductive material and having a base portion and articulated extensions projecting from the base portion of the first shorting bridge to provide a first electrical short interconnection through the first shorting bridge, wherein the articulated extensions include at least a first segment substantially planar with the base portion and a second segment disposed at a predetermined angle relative to the first segment;

a second shorting bridge being of electrical conductive material and having a base portion and articulated extensions projecting from the base portion of the second shorting bridge to provide a second electrical shorting interconnection through the second shorting bridge, wherein the articulated extensions include at least a first segment substantially planar with the base portion and a second segment disposed at a predetermined angle relative to the first segment;

the base portions of the first and second shorting bridges each having at least one surface, the at least one surface of the first shorting bridge facing the at least one surface of the second shorting bridge;

an insulator contacting the at least one surface of both the first and second shorting bridges to space the first shorting bridge from the second shorting bridge, wherein the first and second shorting bridges and the insulator are assembled in a substantially overlapping stack like manner in which the insulator is between and against the base portion of the first and second shorting bridges; and wherein at least one aperature is provided in at least one of the shorting bridges for mounting the shorting device to said electrical connector.

2. A shorting device in accordance with claim 1, wherein said at least one aperture is provided in each of said insulator and the first and second shorting bridges for mounting the shorting device to said electrical connector.

* * * * *